US005505191A

United States Patent [19]

Brown

[11] Patent Number: 5,505,191

[45] Date of Patent: Apr. 9, 1996

[54] FLUSH-MOUNTED CABINET FOR FREE-STANDING FIREBOXES

[76] Inventor: G. Michael Brown, Rte. 3 Box 527P, Hilliard, Fla. 32046

[21] Appl. No.: 385,330

[22] Filed: Feb. 18, 1995

[51] Int. Cl.[6] ..... F24B 1/18

[52] U.S. Cl. ..... 126/500; 126/510; 126/544

[58] Field of Search ..... 126/544, 500, 126/510

[56] References Cited

U.S. PATENT DOCUMENTS

| | | | |
|---|---|---|---|
| Re. 30,437 | 11/1980 | Dew | 126/544 |
| 269,536 | 12/1882 | Page | 126/500 X |
| 453,734 | 6/1891 | Scates | 126/510 |
| 856,060 | 6/1907 | Hepburn | 126/500 |
| 1,671,434 | 5/1928 | Mackay | 126/500 X |
| 1,845,275 | 2/1932 | Hubener | 126/273 A |
| 2,518,005 | 8/1950 | Gustafson et al. | 126/544 |
| 2,875,747 | 3/1959 | Fish | 126/500 X |
| 3,271,914 | 9/1966 | Boyett | 126/500 |
| 4,603,682 | 8/1986 | Maziasz | 126/500 |
| 4,700,687 | 10/1987 | Bailey et al. | 126/500 |
| 4,913,131 | 4/1990 | Petersen | 126/544 |

FOREIGN PATENT DOCUMENTS

| | | | |
|---|---|---|---|
| 915378 | 11/1946 | France | 126/500 |

*Primary Examiner*—Larry Jones
*Attorney, Agent, or Firm*—Thomas C. Saitta

[57] ABSTRACT

A firebox cabinet comprising a front panel, two side panels and a top panel is disclosed, the cabinet mounting flush onto a firebox having a mounting flange. The front panel contains an opening corresponding to the front firebox face, and two recesses surround this opening, the first adapted to receive the mounting flange, the second adapted to provide clearance for fastening members. The front panel locks onto the mounting flange, and the cabinet is preferably of modular construction whereby the components are joined together with self-interlocking joining means.

18 Claims, 2 Drawing Sheets

FLUSH-MOUNTED CABINET FOR FREE-STANDING FIREBOXES

BACKGROUND OF THE INVENTION

The invention relates generally to cabinets or surrounds adapted for use with gas fueled, free-standing fireboxes, and more particularly relates to such cabinets which are adapted to universally mount securely onto various type fireboxes with the front face of the cabinet flush to the face of the firebox.

A firebox is a prefabricated gas fireplace which does not require a chimney and can be installed in a tree-standing manner in a house or building such that it does not need to be incorporated into the wall. An insulated housing and glass front doors completely enclose the burning area, which typically contains a set of artificial logs. Gas is supplied to burners such that the flames pass around the artificial logs to give the illusion of a wood burning fireplace. A small vent pipe conducts waste gases to an outside vent, or in some cases the firebox is designed to require no vent. The fireboxes are relatively stark and utilitarian in appearance, so it is desirable to provide a firebox surround or cabinet for aesthetic purposes. A wood or wood and tile composition cabinet greatly enhances the beauty of the firebox, however the cabinets must adhere to strict fire code and manufacturers regulations in order to insure that the cabinet does not create a hazard because of its proximity to the fire and heat. For example, it is required that the face of the cabinet mount flush to the face of the firebox to prevent entrapment within the cabinet of heat emitted through the front face of the firebox. Additionally, the firebox must be secured to the firebox so that they form an integral unit which cannot be accidently separated or dislodged.

Because of the strict codes and regulations, most current cabinets designed for fireboxes are individually constructed around and onto the firebox during installation of the firebox and require particular carpentry skills, hardware and tools. The cabinet design and method of attachment is dependent on the particular brand or make of firebox. It is an object of this invention to provide for a modular firebox cabinet which can be easily installed onto a firebox without tools, the cabinet having a construction which makes it universally adaptable to securely mount flush on fireboxes of any brand or make.

SUMMARY OF THE INVENTION

The invention comprises in general a firebox cabinet or surround adapted to mount securely onto the standard mounting flange of the firebox. The cabinet comprises a top panel, two side panels, and a front panel having a central opening for the front opening of the firebox, where the front panel may be composed of two leg panels and a cross panel. The cabinet has no rear panel. The interior edge of the front panel opening which surrounds the perimeter of the firebox opening has a particular configuration which allows it to mount directly onto the mounting flange of the firebox while maintaining the face of the front panel flush to the face of the firebox, the configuration having a tolerance which allows the cabinet to be securely mounted to different brands of fireboxes without alteration.

The interior edge of the opening on the front panel is constructed to have a first step or recess followed by a second step or recess. The second recess provides for clearance for any side mounted or top mounted screws on the firebox. The first recess is adapted to receive the mounting flange of the firebox and is properly distanced form the face of the front panel such that the face of the front panel is flush with the face of the firebox. Securing means, such as locking mechanical fasteners, are positioned to attach the front panel to the firebox flange such that the cabinet and firebox form an integral unit. Preferably the cabinet panel members are self-joining with locking clips such that no tools are required. Additionally, the cabinet may be vented at the top and bottom to allow air to be drawn into the cabinet, heated and then directed back into the room.

DETAILED DESCRIPTION OF THE INVENTION

With reference now to the drawings, the invention will be described in detail as to the best mode and preferred embodiment. The invention is a cabinet or surround adapted for use in combination with a free-standing firebox. Such fireboxes are typically constructed of metal in a rectangular configuration or a semi-circular configuration with a fiat face having an opening covered by glass doors. The firebox is fueled by gas and incorporates artificial logs such that the burning gas flames provide an illusion of a wood burning fireplace. Such fireboxes may be vented or non-vented, and can be built into the wall of a room or set out from the wall to extend into the room itself without requiring placement within the wall. The invention is a cabinet designed for use with fireboxes which are free-standing, i.e., not set into the wall, and is used to improve the aesthetic appearance of the firebox. Because of codes and regulations, it is necessary that the front of the cabinet be flush with the firebox and that the cabinet be securely attached to the firebox.

Figure 1:
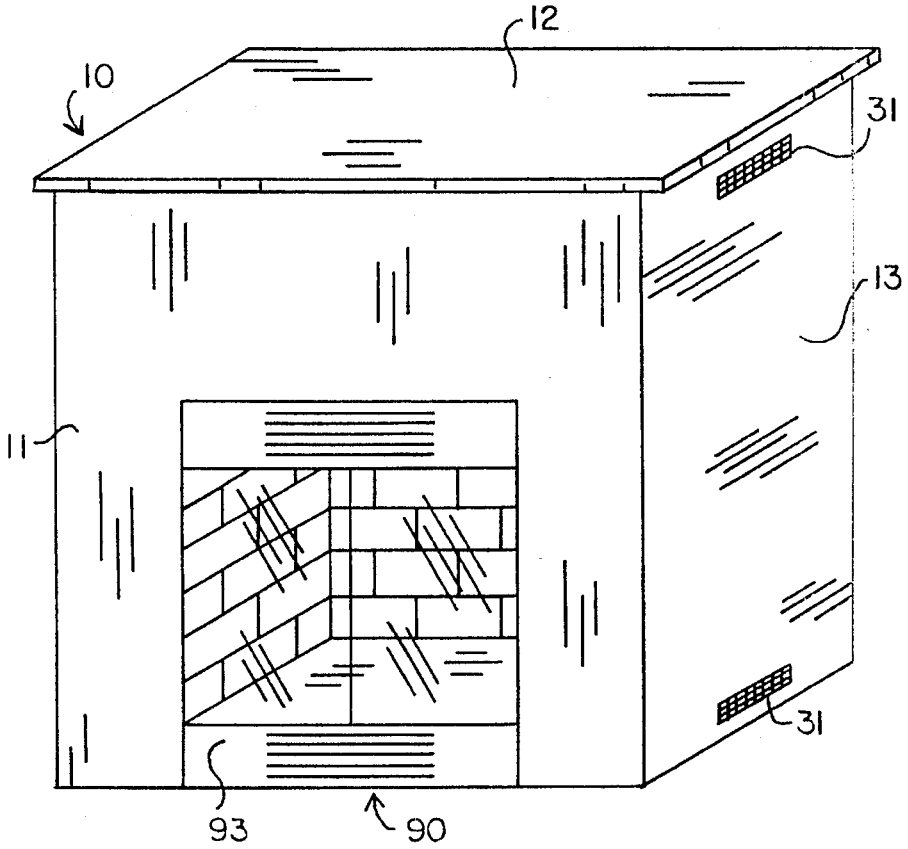
FIG. 1 is a perspective view of the invention mounted onto a firebox.

As shown in FIG. 1, the cabinet 10 comprises a front panel member 11, a top panel member 12 and two side panel members 13 which are joined together to form an enclosure for a firebox 90. Cabinet 10 is open on the back as this side will abut the wall of the room. Front panel 11 can be a single piece or can be comprised of multiple pieces, such as two leg panels and a cross panel joined together, and has a rectangular or square opening 16 which is sized to fit the dimensions of the face 93 of the particular firebox 90 being utilized. The opening 16 will typically be from 30 to 48 inches wide and from 28 to 39 inches tall. Overall dimensions of the cabinet 10 depend on the overall dimensions of the firebox 90 with regard to minimum distances, with the exterior dimensions of the cabinet 10 being a matter of design choice.

Figure 2:
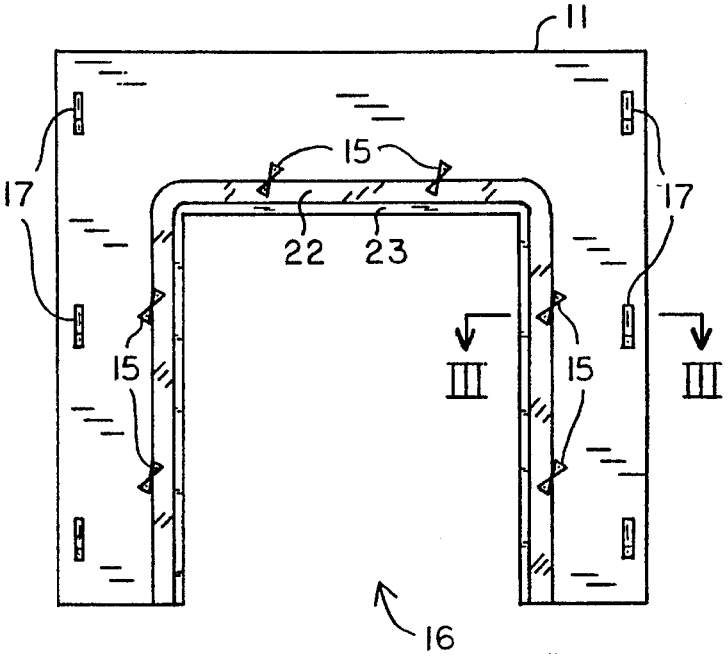
FIG. 2 is a rear view of the front panel.
Figure 3:
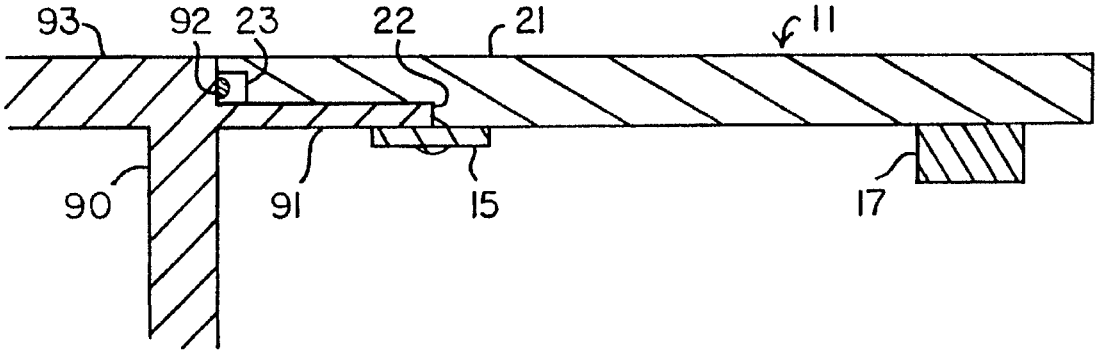
FIG. 3 is a cross-sectional view taken along line III—III of FIG. 2, the front panel mounted onto the mounting flange of a firebox.

In order to insure that the front panel face 21 of cabinet 10 does not extend beyond the firebox face 93 and to insure that the cabinet 10 is suitable for use with different makes and models of known fireboxes 90, it is necessary to provide a particular configuration to the interior edge of the opening 16 in the front panel 11, as shown in FIGS. 2 and 3. All prefabricated fireboxes have a mounting flange 91 which extends from the two sides of the firebox 90 and often from the top of the firebox 90 as well. The mounting flange 91 is a thin piece of metal extending generally from about ¾ inches to 1 and ⅛ inches from the exterior of the firebox 90 and positioned from about ½ inches to ⅝ inches back from the firebox face 93. The cabinet 10 must be fixedly attached to this mounting flange 91 such that together the cabinet 10 and firebox 90 form an integral unit which cannot be accidently separated. In order to accomplish the objectives of a flush and secure attachment between the cabinet 10 and firebox 90 without recourse to excessive construction steps, tools or hardware, the interior edge of the opening 16 in the front panel 11 is provided with a first recess 22 and a second recess 23, whereby the interior of the front panel 11 has a stepped configuration to tightly receive the firebox flange 93.

A preferred thickness for the front panel 11 is approximately ¾ inches, this being the best thickness to match up the interior of the front panel 11 to the back of the firebox flange 93. The first recess 22 is designed to receive the flange 93, and is positioned approximately ½ inches behind the exterior face 21 of front panel 11 and extends approximately 1 and ⅛ inches from the edge of opening 16, preferably on both sides and on top. With these dimensions, the first recess 22 is able to accommodate any of the flanges 93 of differing fireboxes 90 without regard to their exact depth from the front face 93 or their extension distance from the firebox 90. The flange 93 will fit relatively flush into first recess 22 with the back of the flange 93 matching the back of the front panel 11. To attach the front panel 11 to the firebox 90, securing means 15, such as the winged turn clips shown in the figures, are positioned at numerous locations along the edge of the first recess 22, such that when the front panel 11 is properly positioned on the firebox 90, the turn clips can be rotated against the rear of flange 93, pressing the flange 93 against the first recess 22 and thereby locking the front panel 11 onto the firebox 90 to prevent separate movement of the components in either the forward of rearward directions. Because the first recess 22 is positioned the proper depth from the front panel face 21, face 21 will be flush with the firebox face 93 on the exterior as required.

Many fireboxes 90 have screws or other type fastening members 92 extending laterally from the firebox 90 forward of the flange 93. In order to get a tight fit between the opening 16 of the front panel 11 and the firebox 90, it is necessary to provide a second recess 23 around the interior edge of opening 16, preferably on each side and on top, to provide clearance for these fastening members 92. This second recess 23 is located about 3/16 inches behind the front panel face 21 and extends sufficient distance to provide clearance for heads of the fastening members 92, for example about ¼ inches from the interior edge of opening 16. This second recess 23 allows the cabinet 10 to be truly universal, in that the cabinet 10 is able to be mounted onto fireboxes 90 without need for cutting out portions to fit around the fastening members 92.

Figure 4:
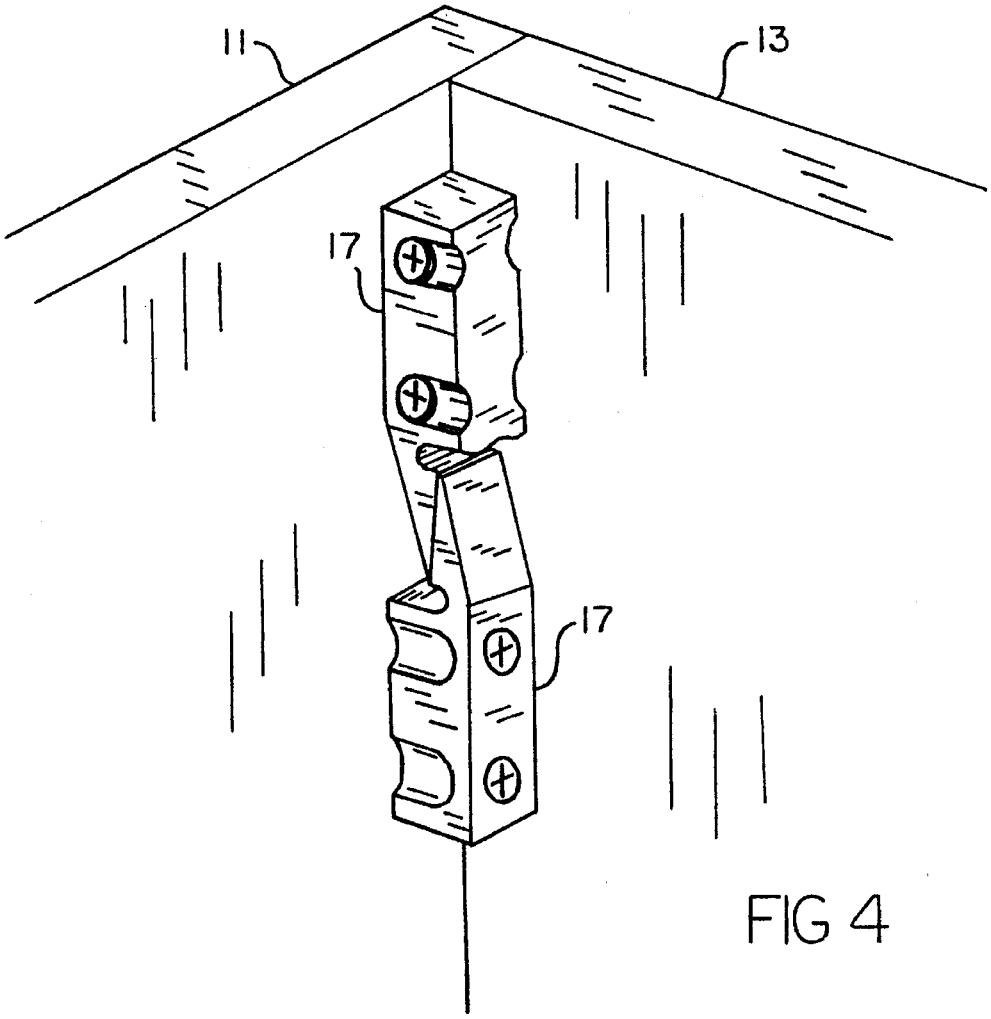
FIG. 4 is a perspective view showing the panel joining means.

In the preferred embodiment, the cabinet 10 is further designed to be modular, such that the front panel 11, top panel 12, and end panels 13 can be easily joined after the front panel 11 is attached to the firebox 90. In the most preferred embodiment, self-interlocking, internal panel joining means 17 are provided which do not require tools in order to join the various components to each other and which are not exposed on the exterior of the cabinet 10, such as the mating clips shown in FIG. 4. These panel joining means 17 allow the side panels 13 to be connected to the front panel 11 by sliding them down between the front panel 11 and the wall of the room, forming a three sided top edge to receive the top panel 12, which can be constructed with a lip and receiving channel to fit over the top edges of the front panel 11 and the side panels 13, further securing the structure. Additionally, vents 31 can be provided which allow air to drawn from the room into the cabinet 10, where it is heated and then expelled back into the room. These vents 31 can be apertures in the panel members or the upper vent 31 can be formed as a gap between the top panel 12 and the side panel 13 or front panel 11 for air flow.

It is understood that equivalents and substitutions to the above described components and examples may be obvious to those skilled in the art. The true scope and definition of the invention therefore is not to be limited by such but is to be as set forth in the following claims.

I claim:

1. A cabinet for use in combination with a firebox having a front firebox face and a mounting flange, the cabinet comprising a front panel, a top panel and two side panels, said front panel having a front panel face, an opening corresponding to said front firebox face, a first recess surrounding said opening adapted to receive said mounting flange, securing means to secure said front panel to said mounting flange whereby said front panel face is flush with said front firebox face, and a second recess surrounding said opening, where said first recess is positioned farther behind said front panel face than said second recess.

2. The device of claim 1, where said first recess is positioned approximately ½ inches behind said front panel face and where said second recess is positioned approximately 3/16 inches behind said front panel face.

3. The device of claim 2, where said first recess extends approximately 1 and ⅛ inches from said opening and where said second recess extends approximately ¼ inches from said opening.

4. The device of claim 1, where said securing means comprise a number of winged turn clips.

5. The device of claim 4, where said securing means are attached to the interior of said front panel.

6. The device of claim 1, where said side panels further comprise a vent.

7. The device of claim 1, where said front panel is joined to said side panels by self-interlocking panel joining members which are mounted on the interior of said front panel and said side panels.

8. The device of claim 1, where said securing means are attached to the interior of said front panel.

9. The device of claim 1, where said second recess is adapted to provide clearance for fastening members connecting said mounting flange to said firebox face, such that said front panel opening abuts said front firebox face.

10. A cabinet adapted for use with a firebox having a front firebox face and a mounting flange, the cabinet comprising a front panel, a top panel and two side panels, said front panel having a front panel face, an opening corresponding to said front firebox face, a first recess surrounding said opening adapted to receive said mounting flange, securing means to secure said front panel to said mounting flange whereby said front panel face is flush with said front firebox face, and a second recess surrounding said opening, where said first recess is positioned farther behind said front panel face than said second recess.

11. The device of claim 10, where said first recess is positioned approximately ½ inches behind said front panel face and where said second recess is positioned approximately 3/16 inches behind said front panel face.

12. The device of claim 11, where said first recess extends approximately 1 and 1/8 inches from said opening and where said second recess extends approximately 1/4 inches from said opening.

13. The device of claim 10 , where said securing means comprise a number of winged turn clips.

14. The device of claim 13, where said securing means are attached to the interior of said front panel.

15. The device of claim 10, where said side panels further comprise a vent.

16. The device of claim 10, where said front panel is joined to said side panels by self-interlocking panel joining members which are mounted on the interior of said front panel and said side panels.

17. The device of claim 10, where said securing means are attached to the interior of said front panel.

18. The device of claim 10, where said second recess is adapted to provide clearance for fastening members connecting said mounting flange to said firebox face, such that said front panel opening abuts said front firebox face.

* * * * *